US010186109B2

(12) United States Patent
Inoue et al.

(10) Patent No.: US 10,186,109 B2
(45) **Date of Patent: *Jan. 22, 2019**

(54) LOTTERY RING, LOTTERY RING UNIT WITH LOTTERY RING, GAME MACHINE WITH LOTTERY RING UNIT, CONTROL METHOD OF CONTROLLING COMPUTER USED IN GAME MACHINE, AND COMPUTER PROGRAM

(71) Applicant: Konami Gaming, Inc., Las Vegas, NV (US)

(72) Inventors: Astsuhi Inoue, Zama (JP); Shoki Kogure, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/611,258

(22) Filed: Jun. 1, 2017

(65) Prior Publication Data

US 2017/0270744 A1 Sep. 21, 2017

Related U.S. Application Data

(63) Continuation of application No. 14/385,109, filed as application No. PCT/US2012/029680 on Mar. 19, 2012, now Pat. No. 9,704,334.

(51) Int. Cl.
*A63F 5/00* (2006.01)
*G07F 17/32* (2006.01)

(52) U.S. Cl.
CPC ..... *G07F 17/3216* (2013.01); *G07F 17/329* (2013.01)

(58) Field of Classification Search
None
See application file for complete search history.

(56) References Cited

U.S. PATENT DOCUMENTS 4,239,223 A 12/1980 Wilson
4,822,048 A 4/1989 Axup
(Continued)

FOREIGN PATENT DOCUMENTS

EP 2 538 395 A1 12/2012
JP S63-124274 A 5/1988
(Continued)

OTHER PUBLICATIONS

Notice of Reasons for Rejection (JP Patent Application No. 2017-006687); dated Apr. 3, 2018.
(Continued)

*Primary Examiner* — Seng Heng Lim
(74) *Attorney, Agent, or Firm* — Howard & Howard Attorneys PLLC

(57) ABSTRACT

A lottery ring includes a first ring and a second ring that have a ring shape and are concentrically arranged so as to form a layer; and a constraining device that operates between a constraint state for constraining the first ring and the second ring such that the first ring and the second ring integrally rotate on the same center and a release state for releasing the constraint state such that the first ring and the second ring relatively rotate, wherein accommodating units that accommodate a physical lottery medium are provided at the first ring along a rotation direction, and information providing units that are arranged along the rotation direction so as to respectively correspond to the accommodating units through the layer, and associated respectively with predetermined information is provided at the second ring.

10 Claims, 15 Drawing Sheets

(56) References Cited

U.S. PATENT DOCUMENTS

| | | | | |
|---|---|---|---|---|
| 4,984,796 | A | 1/1991 | Peacock | |
| 5,316,309 | A | 5/1994 | Takeshi | |
| 5,827,119 | A | 10/1998 | Bromley | |
| 6,164,647 | A | 12/2000 | Chee | |
| 6,217,022 | B1 | 4/2001 | Astaneha | |
| 6,227,542 | B1 | 5/2001 | Cosmi | |
| 7,549,637 | B2 | 6/2009 | Lease | |
| 7,762,883 | B2 | 7/2010 | Griswold et al. | |
| 8,348,277 | B2 | 1/2013 | Fitoussi et al. | |
| 2005/0014550 | A1 | 1/2005 | Rhoten | |
| 2005/0026673 | A1 | 2/2005 | Paulsen et al. | |
| 2005/0288089 | A1 | 12/2005 | Cammegh et al. | |
| 2006/0033268 | A1 | 2/2006 | Wong | |
| 2006/0046837 | A1 | 3/2006 | Ito et al. | |
| 2007/0265056 | A1 | 11/2007 | Yoshizawa | |
| 2009/0005149 | A1 | 1/2009 | Okuaki et al. | |
| 2010/0102507 | A1 | 4/2010 | Bontempo et al. | |
| 2010/0109237 | A1 | 5/2010 | Cammegh et al. | |
| 2010/0167804 | A1 | 7/2010 | Okuaki et al. | |
| 2011/0180990 | A1 | 7/2011 | Fitoussi et al. | |
| 2011/0281631 | A1* | 11/2011 | Bontempo | A63F 5/00 463/17 |
| 2013/0154186 | A1 | 6/2013 | Kang | |
| 2014/0187306 | A1 | 7/2014 | Nordahl et al. | |

FOREIGN PATENT DOCUMENTS

| | | | |
|---|---|---|---|
| JP | 05217182 | A2 | 8/1993 |
| JP | 06032600 | A2 | 2/1994 |
| JP | 2004016367 | A2 | 1/2004 |
| JP | 2007-215783 | A | 8/2007 |
| JP | 2010-119679 | A | 6/2010 |
| JP | 2011-239966 | A | 12/2011 |
| JP | 2012-100874 | A | 5/2012 |
| JP | 6081595 | B2 | 2/2017 |
| WO | 2010058711 | A1 | 5/2010 |
| WO | 2011/145376 | A1 | 11/2011 |

OTHER PUBLICATIONS

Notice of Reasons for Rejection (JP Patent Application No. 2017-016963); dated Apr. 3, 2018.

Notice of Reasons for Rejection—English Translation with Original Japanese Office Action (JP Patent Application No. 2017-006687; O/R: 068520.00087); Dispatch Date: Oct. 23, 2018.

* cited by examiner

LOTTERY RING, LOTTERY RING UNIT WITH LOTTERY RING, GAME MACHINE WITH LOTTERY RING UNIT, CONTROL METHOD OF CONTROLLING COMPUTER USED IN GAME MACHINE, AND COMPUTER PROGRAM

CROSS REFERENCE TO RELATED APPLICATION

This application is a continuation of U.S. patent application Ser. No. 14/385,109, filed Apr. 15, 2015, which is a national stage of PCT/US2012/029680, filed Mar. 19, 2012, the disclosure of which is hereby incorporated by reference in its entirety.

TECHNICAL FIELD

The present invention relates to a lottery ring or the like used for a lottery using a physical lottery medium.

BACKGROUND ART

There is a lottery ring used for a lottery using a physical lottery medium. As one of such lottery rings, there is a roulette ring, in which pockets for accommodating balls as physical lottery media are provided along an outer circumference, used in a roulette game. And, a game machine which provides a roulette game using such the roulette ring has been known (for example, see Patent Literature 1). Patent Literature 1: Japanese Patent Application Laid-Open No. 2007-215783.

SUMMARY OF INVENTION

Technical Problem

It is an object of the present invention to provide a novel lottery ring, lottery ring unit with the lottery ring, game machine with the lottery ring unit, control method of controlling a computer used in the game machine, and computer program.

Solution to Problem

A lottery ring according to the present invention comprises: a first ring and a second ring that have a ring shape and are concentrically arranged so as to form a layer; and a constraining device that operates between a constraint state for constraining the first ring and the second ring such that the first ring and the second ring integrally rotate on the same center and a release state for releasing the constraint state such that the first ring and the second ring relatively rotate, wherein accommodating units that accommodate a physical lottery medium for performing a lottery are provided at the first ring along a rotation direction, and information providing units that are arranged along the rotation direction so as to respectively correspond to the accommodating units through the layer, and associated respectively with predetermined information is provided at the second ring.

DESCRIPTION OF EMBODIMENTS

Figure 1:
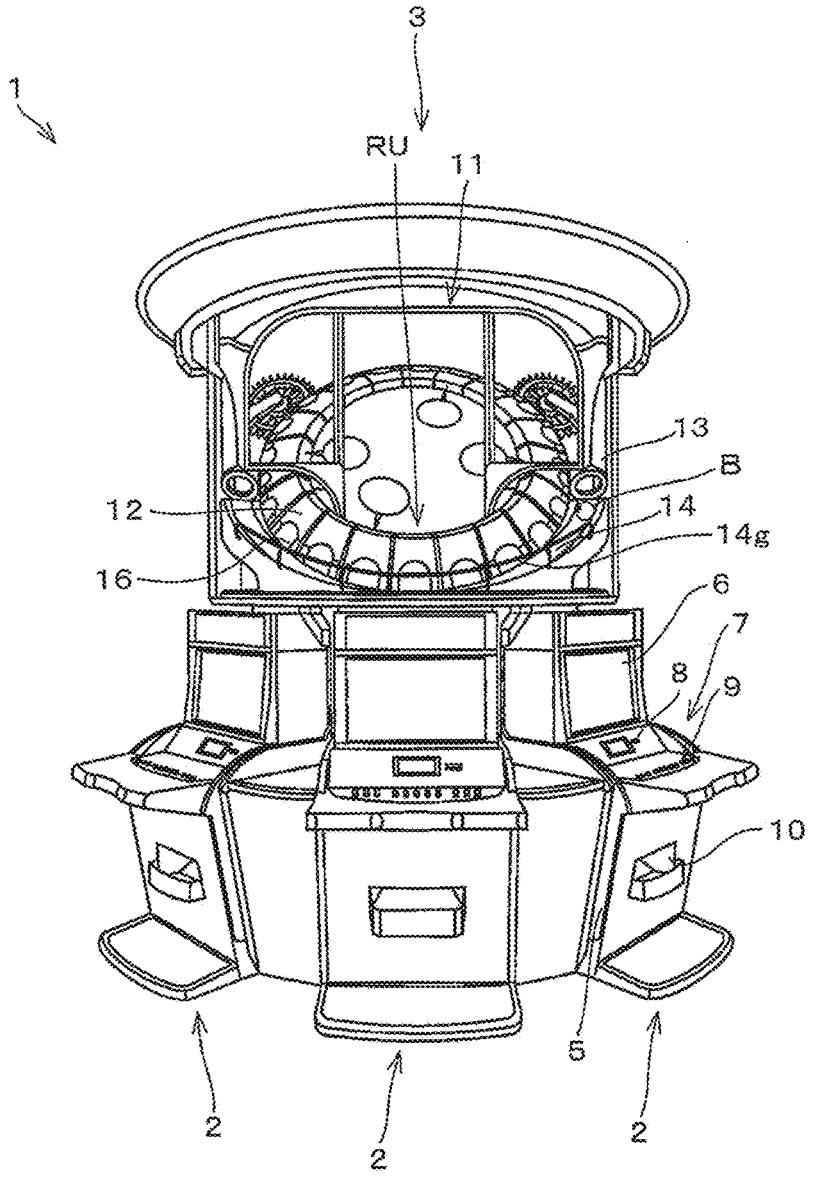
FIG. 1 is an external appearance view of a game machine according to an embodiment of the present invention.

Hereinafter, a game machine according to an embodiment of the present invention will be described with reference to the drawings. FIG. 1 is an external appearance view of a game machine according to an embodiment of the present invention. As illustrated in FIG. 1, a game machine 1 includes station units 2 and a center unit 3. The station units 2 are arranged around the center unit 3. In addition, the number of station units 2 may be an appropriate number. For example, the number of station units 2 may be one.

For example, the station unit 2 provides a slot game in exchange for consumption of coins as a game value. The slot game refers to a well-known game in which displays of symbols change according to a lottery result, and a predetermined privilege is given when a combination of changed displays of symbols forms a predetermined winning arrangement. A well-known slot game machine may be used as the station unit 2. For example, the station unit 2 includes a housing 5. A station monitor 6 is disposed on the front surface of the housing 5. For example, a liquid crystal display (LCD) device is used as the station monitor 6. A control panel 7 is disposed below the station monitor 6. The control panel 7 includes a coin slot 8 and an operation device 9. For example, the operation device 9 includes an operation member such as a button switch for performing various operations such as a bet operation. A coin-payout opening 10 is disposed below the control panel 7.

Meanwhile, the center unit 3 provides a so-called roulette game when a predetermined game condition is satisfied by the station unit 2. The roulette game refers to a well-known game that executes a lottery using motion that a ball rotationally moves along the outer circumference of a circular roulette wheel and gets into any one of pockets disposed along the outer circumference of the roulette wheel. For example, in the slot game, a condition that satisfies a requirement when specific symbols form a winning arrangement in a slot game is employed as the predetermined game condition. In addition, the predetermined game condition is not limited to this form. For example, as the predetermined game condition, there may be used various conditions related to the slot game such as a condition satisfied when the winning arrangement is formed a predetermined number of times or more, or a condition satisfied when a specific winning arrangement is formed. Or, when a game other than a slot game is executed by the station unit 2, various conditions related to the game may be employed as the predetermined game condition.

The center unit 3 includes a center monitor 11, a roulette unit RU as a lottery ring unit, a ball feeding mechanism 13, and a ball guidepath 14. The roulette unit RU has a roulette ring 12 as a lottery ring. The roulette unit RU is arranged such that a front side (a side at which the station unit 2 is arranged) of the roulette ring 12 is positioned downwardly, a rear side of an opposite side is positioned upwardly, and so the roulette ring 12 is inclined. Further, the roulette unit RU is arranged below the center monitor 11 so that the rear side of the roulette ring 12, i.e., an upper portion of the inclination is hidden by the center monitor 11. The roulette ring 12 is rotationally driven in a predetermined direction at a predetermined speed by a ring drive mechanism 15 (see FIG. 2) functioning as a rotary drive device. Pockets 16 as accommodating units are provided around the roulette ring 12. Each pocket 16 is associated with a predetermined privilege.

The ball feeding mechanism 13 feeds a ball B as a physical lottery medium to the ball guidepath 14. The ball guidepath 14 is formed to extend along the outer circumference of the roulette ring 12. A guard 14*g* for limiting a movement of the ball B is provided at an outer circumference side of the ball guidepath 14, i.e., the opposite side of the roulette ring 12. The guard 14*g* limits the movement of the ball B so as to prevent the ball B from being led astray from the ball guidepath 14. That is, the ball guidepath 14 is formed so as to limit a moving range of the ball B fed by the ball feeding mechanism 13 to a certain range, and guide the ball B to the pocket 16 of the roulette ring 12.

Meanwhile, the center monitor 11 displays an image which makes up for the hidden portion of the roulette ring 12. Specifically, as illustrated in FIG. 1, the center monitor 11 display an image corresponding to the hidden portion of the roulette ring 12 such that the image has continuity with the roulette ring 12. With the rotation of the roulette ring 12, an image corresponding to the roulette ring 12 displayed on the center monitor 11 rotates so as to virtually show the rotation of the roulette ring 12. Similarly, when the roulette ring 12 stops, the image corresponding to the roulette ring 12 displayed on the center monitor 11 also stops. The display of the image is realized by simulating an operation such as rotation and stop of the roulette ring 12.

When a roulette game starts, the roulette ring 12 starts to rotate. The ball B is fed to the ball guidepath 14 by the ball feeding mechanism 13. The fed ball B moves along the ball guidepath 14. Since the roulette ring 12 is inclined such that the front side is positioned downwardly, the ball guidepath 14 is similarly inclined. Thus, the fed ball B moves toward the opposite side of the ball feeding mechanism 13 along the ball guidepath 14, however, the ball B changes the moving direction in the middle of the inclination and so moves to return to the ball feeding mechanism 13 side. After this movement is repeated several times, the moving range of the ball B converges to the lowermost position of the ball guidepath 14, i.e., the lowermost position of the roulette ring 12. Then, the ball B gets into any one pocket 16 (mainly, the pocket 16 at the lowermost position at an appropriate time) of the roulette ring 12 at an appropriate time. A player is given a predetermined privilege associated with the pocket 16 into which the ball has gotten.

Figure 2:
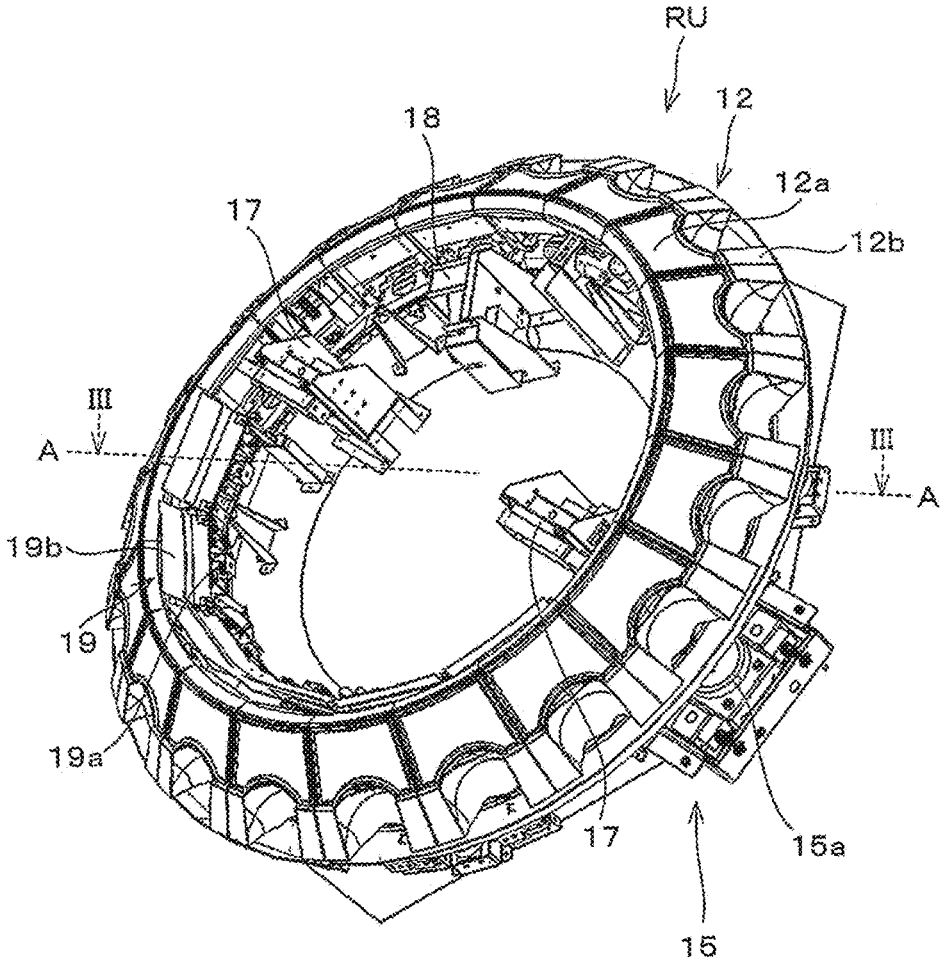
FIG. 2 is an enlarged view of a roulette unit.

FIG. 2 is an enlarged view of the roulette unit RU. As illustrated in FIG. 2, a motor unit 15*a* of the ring drive mechanism 15 is arranged below the roulette ring 12 to rotationally drive the roulette ring 12. The roulette ring 12 is formed in a ring shape in which a space is formed in a central portion. The roulette ring 12 is configured as a dual ring which can be divided into an award ring 12*a* as a second ring and a pocket ring 12*b* as a first ring, which are concentrically arranged and performs concentric movement.

In the roulette unit RU, a pair of pin lifting units 17 as a switching device, a brake unit 18, and a light-emitting diode (LED) unit 19 are provided. These components are arranged inside the roulette ring 12, i.e., in the space formed in the central portion. The LED unit 19 includes an LED light 19*a* and a reflecting plate 19*b*. The LED light 19*a* is arranged as a lighting device so as to emit light toward the reflecting plate 19*b*. The reflecting plate 19*b* is arranged so as to reflect light emitted from the LED light 19*a* in a specific direction. For example, the reflecting plate 19*b* includes an upper reflecting plate that reflects light upward in the award ring 12*a* and a lower reflecting plate that reflects light downward. Further, as an example, the LED light 19*a* is configured to be able to switch an emission direction of light between emission to the upper reflecting plate and emission to the lower reflecting plate. The details of the pin lifting unit 17 and the brake unit 18 will be described later.

Figure 3:
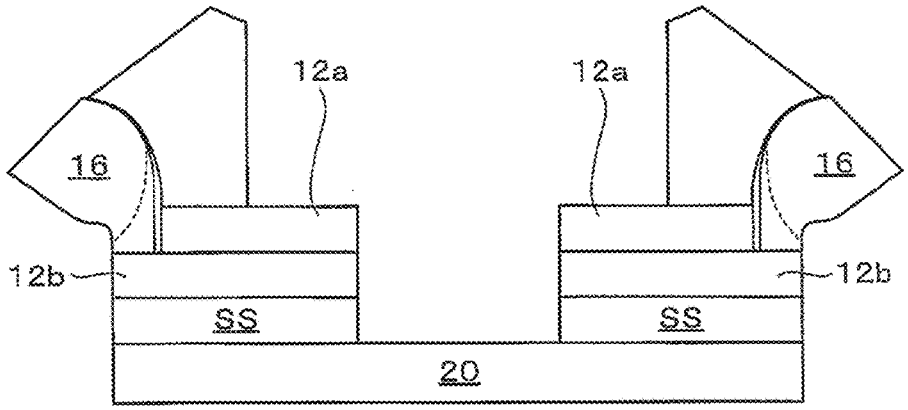
FIG. 3 is a schematic cross-sectional view schematically illustrating a cross section taken along line A-A of FIG. 2.

FIG. 3 is a schematic cross-sectional view schematically illustrating a cross section taken along line A-A of FIG. 2. As illustrated in FIG. 3, the roulette ring 12 has a dual layer structure in which the award ring 12*a* and the pocket ring 12*b* are arranged in order from the top. The placement layer SS on which the roulette ring 12 is placed is formed below the pocket ring 12*b* in the same ring shape as the roulette ring 12. Various components necessary for rotatably placing the roulette ring 12 are arranged in the placement layer SS. The placement layer SS is formed on a base portion 20. That is, the roulette ring 12 is arranged on the base portion 20 with the placement layer SS interposed therebetween. The base portion 20 is arranged to be formed on the bottom of the space in which the award ring 12*a* and the pocket ring 12*b* are formed. Thus, the base portion 20 also functions as the foundation of the pin lifting unit 17, the brake unit 18 and, and the LED unit 19.

Figure 4:
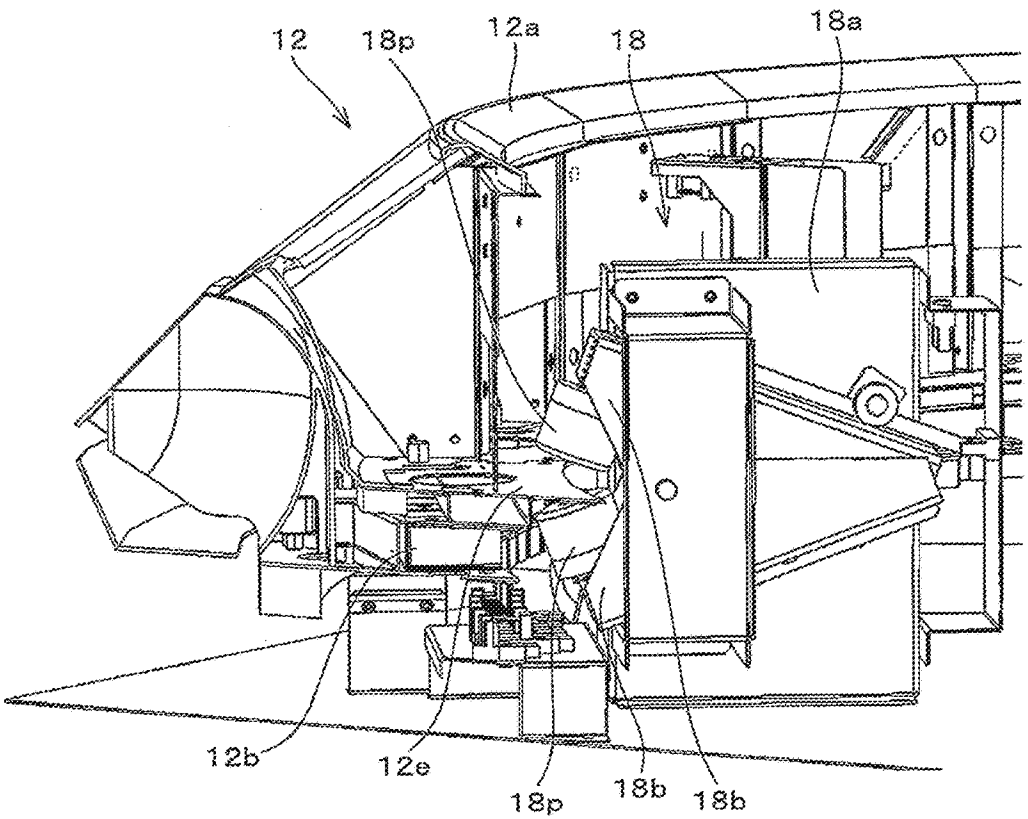
FIG. 4 is an enlarged view schematically illustrating the brake unit illustrated in FIG. 2.

Next, the details of the brake unit 18 will be described with reference to FIG. 4. FIG. 4 is an enlarged view schematically illustrating the brake unit 18 illustrated in FIG. 2. As illustrated in FIG. 4, the brake unit 18 includes a unit body 18*a* and a pair of brake portions 18*b*. A drive source (not illustrated) for driving the pair of the brake portions 18*b* is provided inside the unit body 18*a*. A pair of brake pads 18*p* is provided at the leading end of the pair of brake portions 18*b*. Each brake pad 18*p* has a cylindrical shape. Meanwhile, an extension portion 12*e* is provided in the pocket ring 12*b*. The extension portion 12*e* is formed such that the top surface of the pocket ring 12*b* extends toward the center. That is, the extension portion 12*e* protrudes in the center direction farther than the inner wall of the pocket ring 12*b*. The pair of brake pads 18*p* is arranged at the upper and lower sides of the extension portion 12*e* while interposing the extension portion 12*e* therebetween.

The pair of brake portions 18*b* is configured so as to operate by the drive source between a stop position at which the pair of brake pads 18*p* hold the extension portion 12*e* in an up-down direction and a release position at which the pair of brake pads 18*p* release the extension portion 12*e*. That is, the brake unit 18 is configured so as to stop rotation of the pocket ring 12*b* by holding the extension portion 12*e* through the pair of brake pads 18*p* and allow rotation of the pocket ring 12*b* by releasing the extension portion 12*e*.

Figure 5:
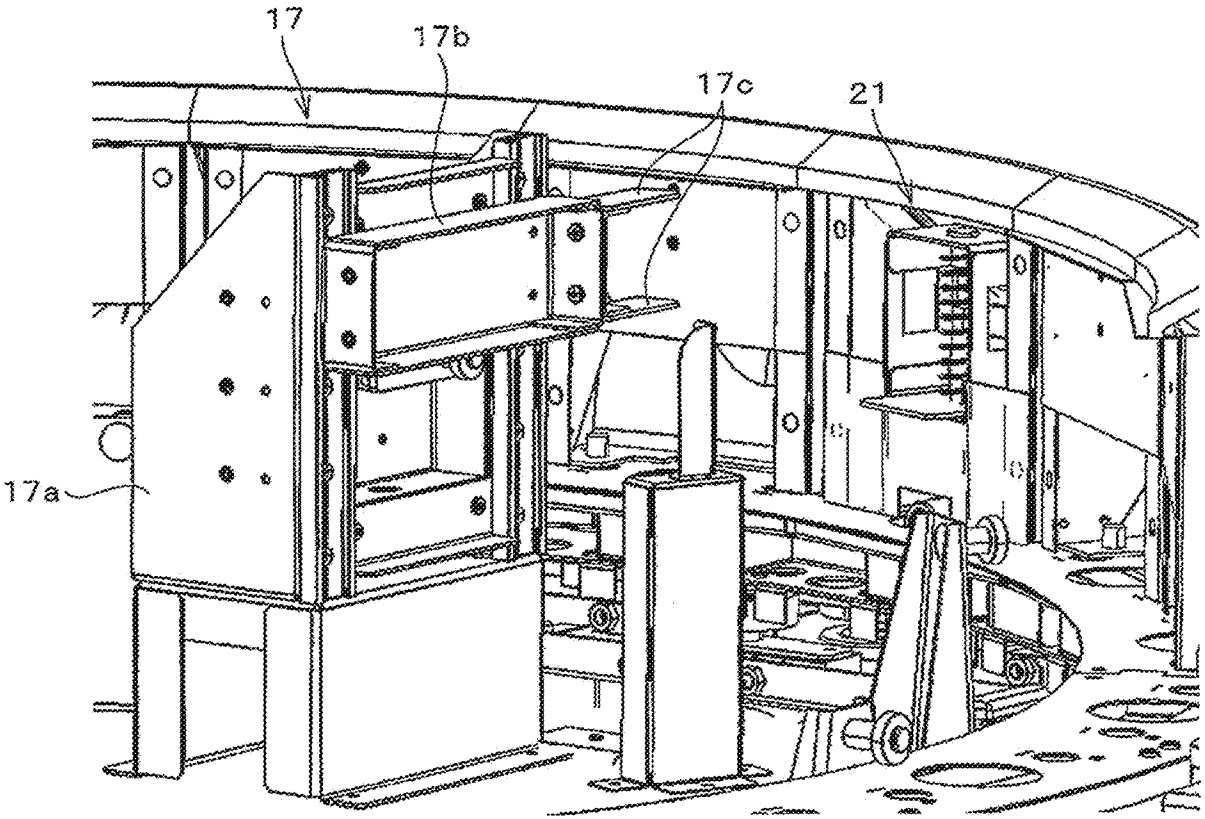
FIG. 5 is an enlarged view schematically illustrating a portion in which one pin lifting unit illustrated in FIG. 2 is arranged.

Next, the details of the pin lifting unit 17 will be described. The pair of pin lifting units 17 is arranged in symmetrically positions. FIG. 5 is an enlarged view schematically illustrating a portion in which one pin lifting unit 17 illustrated in FIG. 2 is arranged. As illustrated in FIG. 5, each pin lifting unit 17 includes a unit body 17*a* and a lifting portion 17*b*. The unit body 17*a* is configured as a mechanism for moving the lifting portion 17*b* up or down in the up-down direction. A drive source (not illustrated) for moving the lifting portion 17*b* up or down is provided inside the unit body 17*a*. In this way, the lifting portion 17*b* is configured to be able to move up to near the upper end of the award ring 12*a*. A pair of protruding portions 17*c* formed to protrude in the direction of the award ring 12*a* and the pocket ring 12*b* are provided in the lifting portion 17*b*. The pair of protruding portions 17*c* is arranged with an interval therebetween in the up-down direction.

Figure 6A:
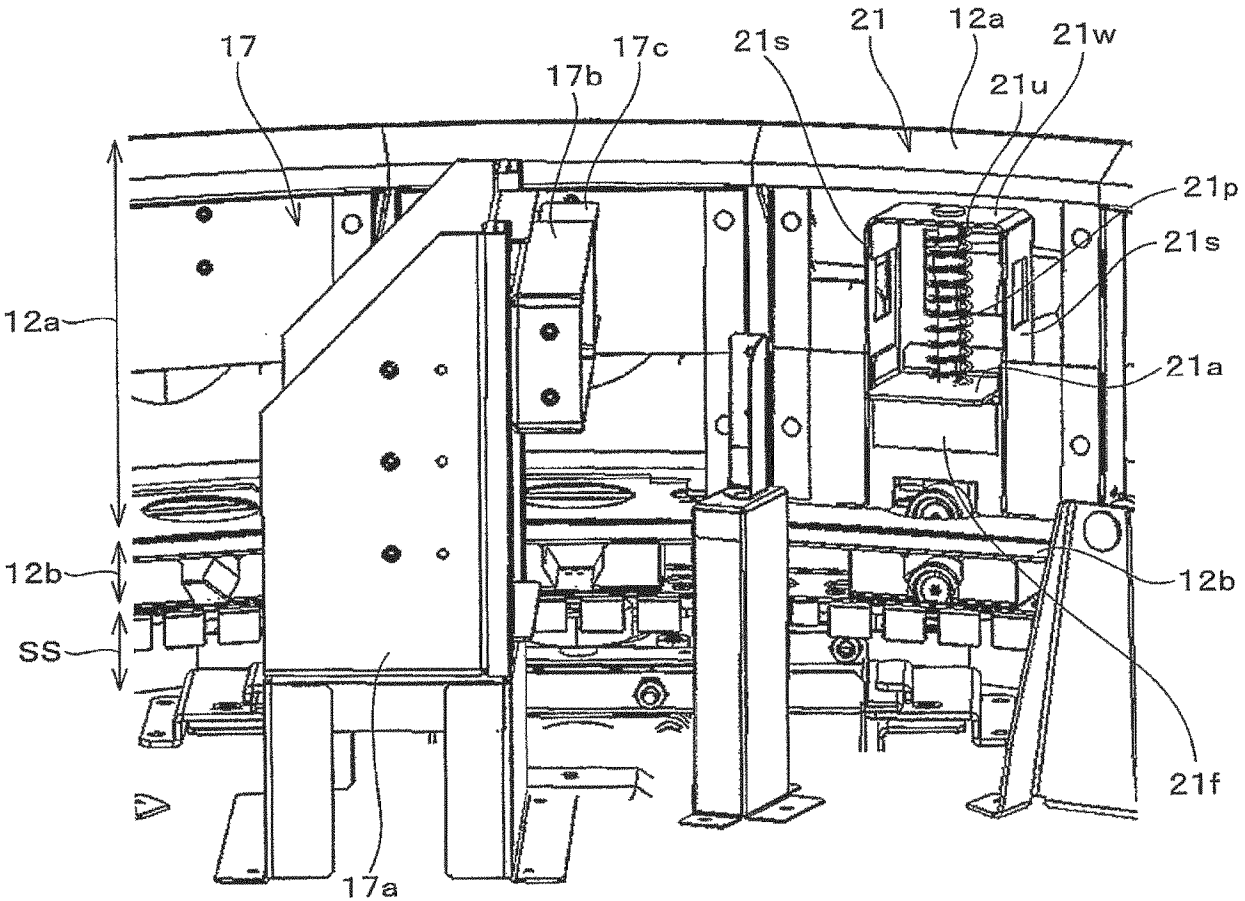
FIG. 6A is a schematic diagram illustrating a switching mechanism viewed in a direction different from FIG. 5.

Meanwhile, a constraining mechanism 21 as a constraining device is provided in the roulette ring 12. The constraining mechanism 21 operates between a constraint state in which motion of the award ring 12*a* in the rotation direction is constrained to the pocket ring 12*b* and a release state in which the constraint is released. The state of the constraining mechanism 21 is switched by the pin lifting unit 17. The details of the constraining mechanism 21 and switching of the state of the constraining mechanism 21 by the pin lifting unit 17 will be described with reference to FIGS. 6A to 6C. FIG. 6A is a schematic diagram illustrating the constraining mechanism 21 viewed in a direction different from FIG. 5. As illustrated in FIG. 6A, the constraining mechanism 21 is provided in the award ring 12*a*. Two constraining mechanisms 21 are arranged in symmetrically positions of the award ring 12*a* to correspond to the pair of pin lifting units 17. In addition, the positions at which the constraining mechanisms 21 are arranged are not limited to the symmetrically positions. The constraining mechanisms 21 may be arranged at any positions to the extent that the constraining mechanisms 21 are switchable between the constraint state and the release state. Further, an arbitrary number of constraining mechanisms 21 may be arranged. For example, one constraining mechanism 21 or three or more constraining mechanisms 21 may be arranged.

In the constraining mechanism 21, an engaging portion 21*a* that protrudes in the center direction of the roulette ring 12 is provided so as to engage with the pair of protruding portions 17*c*. The engaging portion 21*a* is configured so that the movement in the up-down direction is allowed, and the movement in the left-right direction is limited by a side wall 21*s*. A spring 21*u* is disposed between the engaging portion 21*a* and the upper wall 21*w*. The engaging portion 21*a* is pushed downward by the spring 21*u*.

On the other side, the movement of the engaging portion 21*a* in the downward direction is limited by a front wall 21*f* That is, the engaging portion 21*a* is pushed by the spring 21*u* to come into contact with the front wall 21*f*.

A pin 21*p* whose one end portion protrudes below the engaging portion 21*a* is provided near the center of the engaging portion 21*a*. The pin 21*p* is fixed to the engaging portion 21*a*. That is, the pin 21*p* is configured such that with the movement of the engaging portion 21*a* in the up-down direction, the pin 21*p* moves together with the engaging portion 21*a* in the up-down direction. One end portion of the pin 21*p* is inserted into an insertion portion (not illustrated) provided in the pocket ring 12*b*. The insertion portion is disposed for each pocket 16 to correspond to each the pocket 16. Meanwhile, the other end portion of the pin 21*p* protrudes above the engaging portion 21*a*. A gap is present between the other end portion of the pin 21*p* and the upper wall 21*w*. This gap is formed so as to be able to allow one end portion of the pin 21*p* to come off from the insertion portion and then to sufficiently move to the award ring 12*a* side.

When the engaging portion 21*a* is pushed by the spring 21*u* and is located at a constraint position at which the engaging portion 21*a* comes into contact with the front wall 21*f*, since one end portion of the pin 21*p* remains inserted into an insertion hole, movement of the award ring 12*a* in a left-right direction is constrained by the pocket ring 12*b*. In the constraint state like this, the pair of protruding portions 17*c* is arranged at non-contact positions at which the protruding portions 17*c* do not come into contact with the engaging portion 21*a*. Thus, in the constraint state, when the ring drive mechanism 15 rotates the pocket ring 12*b*, the award ring 12*a* rotates together with the pocket ring 12*b*. That is, in this case, the award ring 12*a* and the pocket ring 12*b* integrally rotate.

Figure 6B:
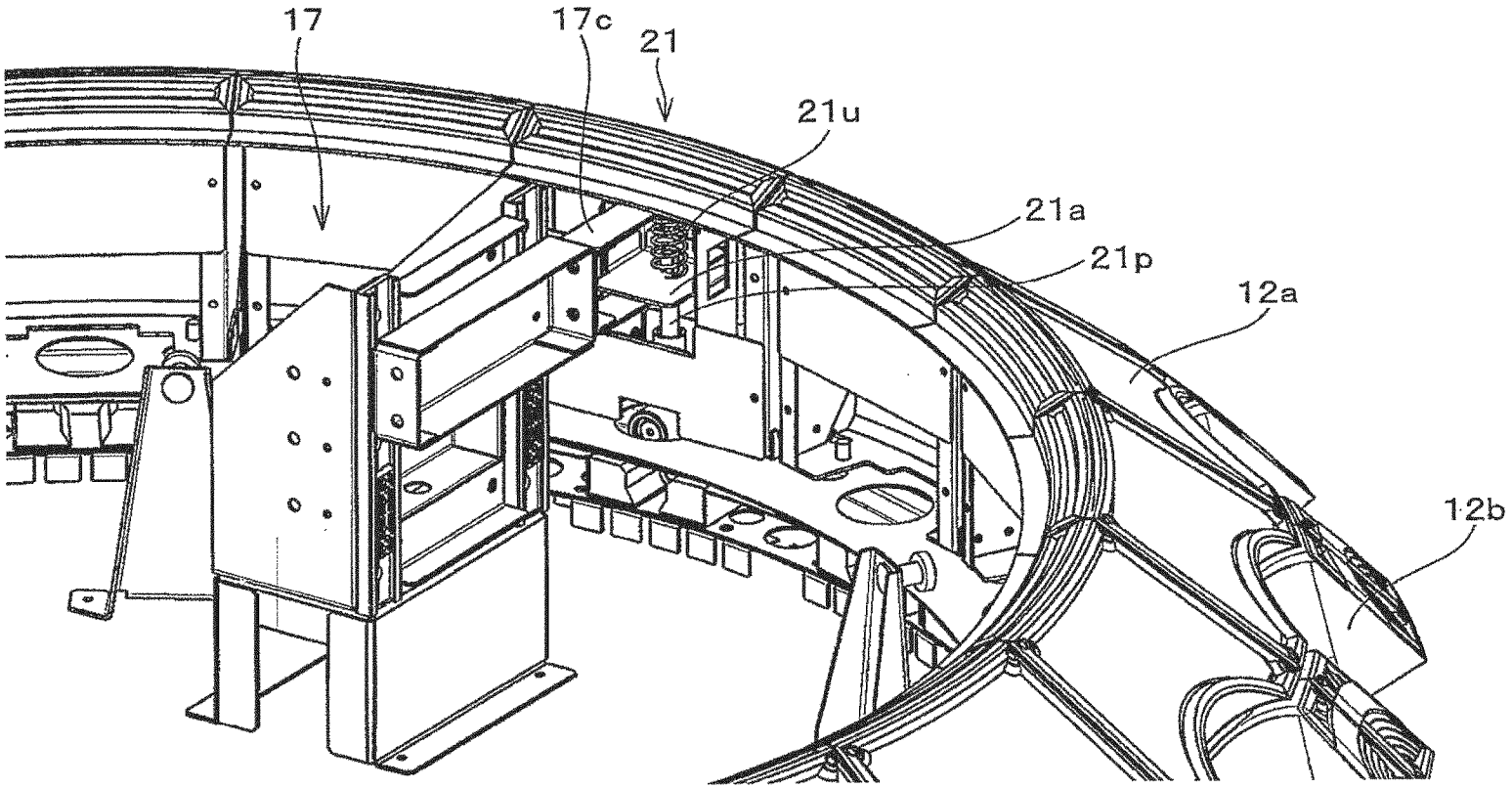
FIG. 6B is a diagram illustrating an example of a state in which a pair of protruding portions engages with an engaging portion.

Meanwhile, the engaging portion 21*a* engages with the pair of protruding portions 17*c*. FIG. 6B is a diagram illustrating an example of a state in which the pair of protruding portions 17*c* engages with the engaging portion 21*a*. As illustrated in FIG. 6B, in a state in which the pair of protruding portions 17*c* engage with the engaging portion 21*a*, the engaging portion 21*a* is arranged between the pair of protruding portions 17*c*. More specifically, the engaging portion 21*a* is arranged above the lower side of the pair of protruding portions 17*c*. The pair of protruding portions 17*c* is movable in the up-down direction by the drive source. Thus, when the pair of protruding portions 17*c* move up in the state in which the pair of protruding portions 17*c* engage with the engaging portion 21*a*, the engaging portion 21*a* moves up with the movement. Through this movement, the spring 21*u* is compressed, one end portion of the pin 21*p* moves up together with the engaging portion 21*a*. When the pin 21*p* comes off from the insertion portion and moves up to the award ring 12*a*, the constraint of the award ring 12*a* is released. In the release state like this, the award ring 12*a* and the pocket ring 12*b* can rotate independently of each other.

A movable range of the lifting portion 17*b* is near the upper end portion of the award ring 12*a*. That is, the movable range of the lifting portion 17*b* is higher than the upper wall 21*w*. Thus, each pin lifting unit 17 can move the engaging portion 21*a* up to the position higher than the upper wall 21*w*. The constraining mechanism 21 is provided in symmetrically positions of the award ring 12*a* so as to correspond to the pair of pin lifting units 17. Thus, the pair of pin lifting units 17 lifts the award ring 12*a* up to the position at which the award ring 12*a* is separated from the pocket ring 12*b*. When the pair of protruding portions 17*c* is at the separation position like this, a separation state is formed between the pocket ring 12*b* and the award ring 12*a*. In the separation state like this, movement of the award ring 12*a* in the rotation direction is limited by the pin lifting unit 17 that supports the weight of the award ring 12*a*. Thus, when the ring drive mechanism 15 rotates the pocket ring 12*b* in the separation state, the pocket ring 12*b* which is not limited in the rotation direction rotates, but rotation of the award ring 12*a* is limited. That is, the pocket ring 12*b* rotates relatively to the award ring 12*a* that does not rotate.

Since the insertion portion at the pocket ring 12*b* side is provided for each pocket 16 to correspond to each pocket 16, an insertion location of the pin 21*p* can be changed to an arbitrary insertion portion. That is, the insertion location of the pin 21*p* can be changed in units of pockets 16. In this embodiment, the state of the pin lifting unit 17 when the release state is formed, that is, the state in which the pair of protruding portions 17*c* are at the non-contact position functions as a permission state of the present invention. And, the state of the pin lifting unit 17 when the separation state is formed, that is, the state in which the pair of protruding portions 17*c* are at the separation position functions as a limiting state of the present invention. Further, the pin lifting unit 17 which limits rotation of the award ring 12*a* functions as a rotation limiting device of the present invention.

Figure 6C:
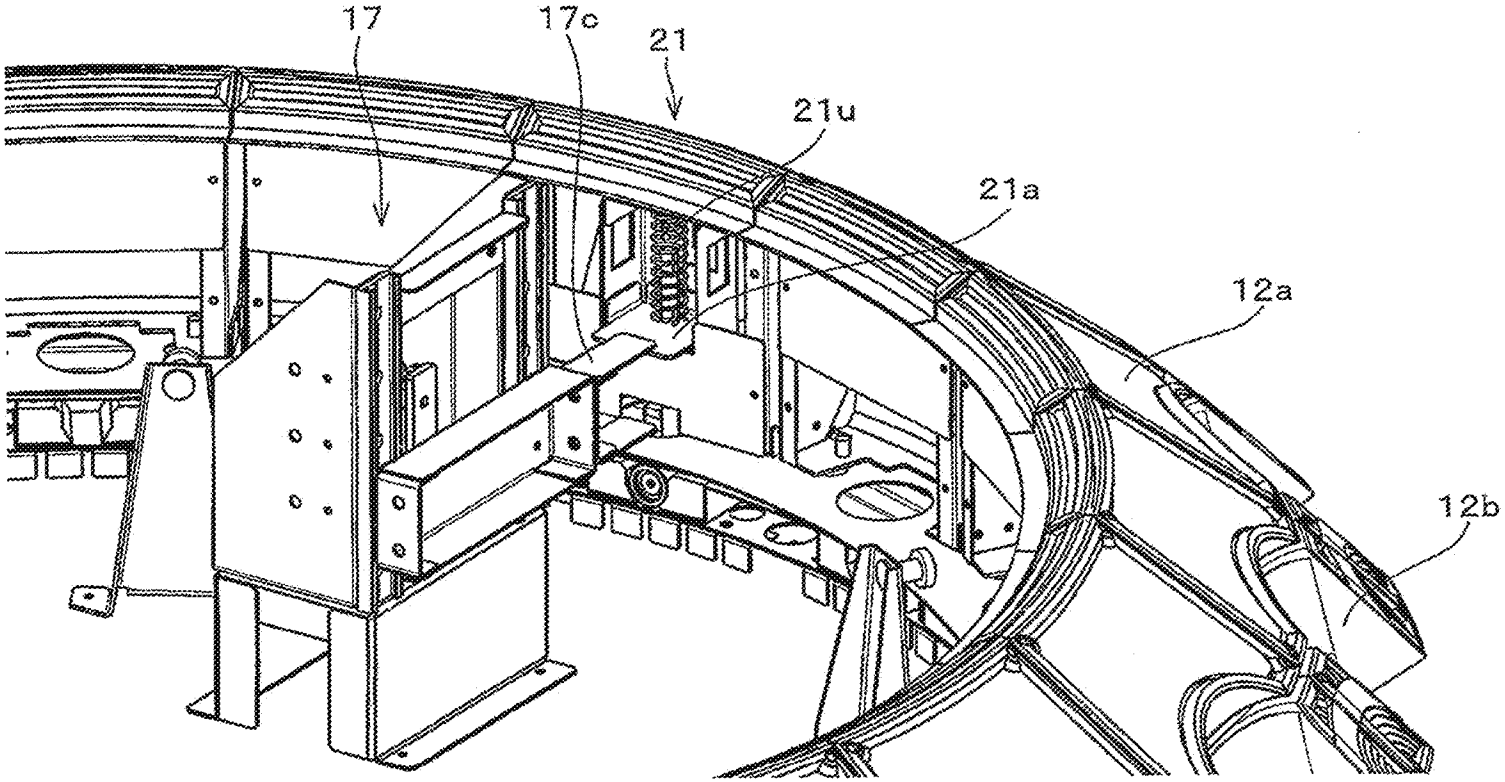
FIG. 6C is a diagram illustrating an example in which a pair of protruding portions operates to insert a pin.

In addition, the pair of protruding portions 17*c* may operate to insert the pin 21*p*. The engaging portion 21*a* is pushed by the spring 21*u*. Thus, when engagement between the pair of protruding portions 17*c* and the engaging portion 21*a* is released, the pin 21*p* moves in the insertion portion direction by the spring 21*u*. However, high resistance may occur when the pin 21*p* is inserted into the insertion portion. In this case, the pin 21*p* may not be inserted into the insertion portion only through the spring 21*u*. FIG. 6C is a diagram illustrating an example in which the pair of protruding portions 17*c* operates to insert the pin 21*p*. As illustrated in FIG. 6C, the pair of protruding portions 17*c* may operate to push the engaging portion 21*a* down in a state in which the pair of protruding portions 17*c* engages with the engaging portion 21*a*. In this case, the pin 21*p* is pushed into the insertion portion with the downward movement of the engaging portion 21*a*. Accordingly, the pin 21*p* is reliably inserted into the insertion portion.

Figure 7:
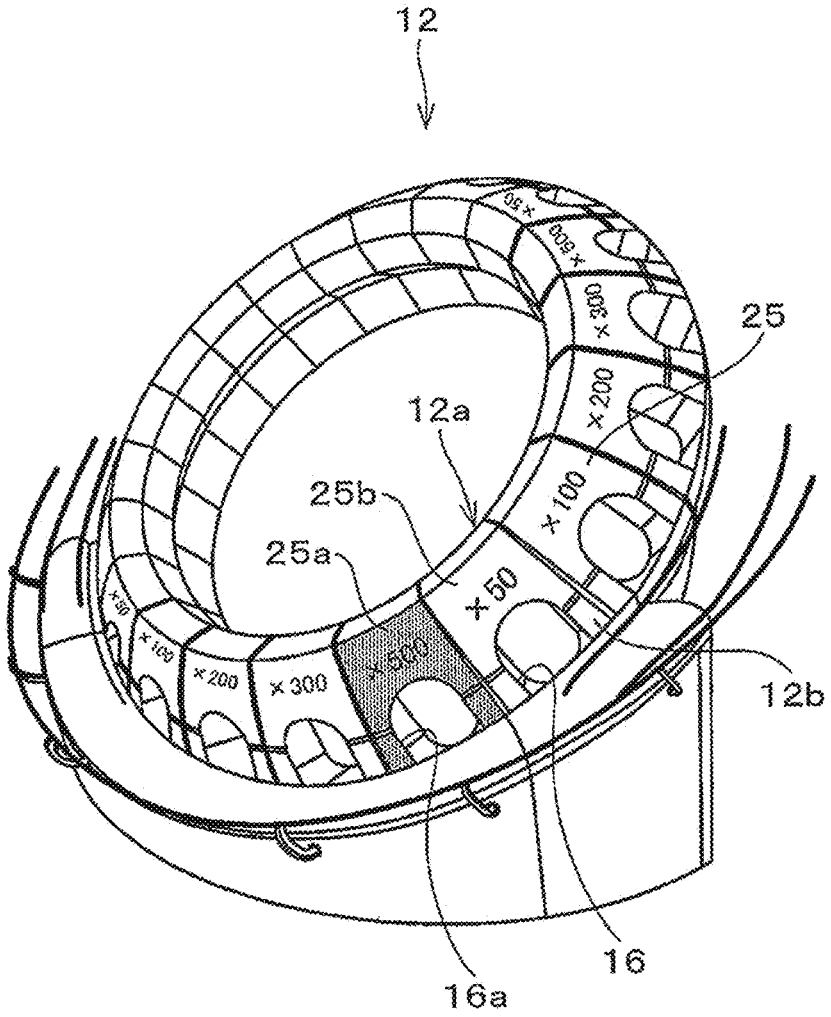
FIG. 7 is a diagram schematically illustrating a state before relative rotation between an award ring and a pocket ring occurs.

Next, relative rotation occurring between the award ring 12*a* and the pocket ring 12*b* will be further described with reference to FIGS. 7 to 12. FIG. 7 is a diagram schematically illustrating a state before relative rotation between the award ring 12*a* and the pocket ring 12*b* occurs. As illustrated in FIG. 7, each pocket 16 is provided in the pocket ring 12*b*. Meanwhile, a privilege display unit 25 as an information providing unit is provided in the award ring 12*a* so as to correspond to each pocket 16. Each privilege display unit 25 is associated with a predetermined privilege as predetermined information. And, in the constraint state, each privilege display unit 25 is arranged so as to correspond to each pocket 16 through upper and lower layers interposed therebetween. When the ball B enters the pocket 16, there is given a predetermined privilege associated with the privilege display unit 25 arranged so as to correspond to the pocket. That is, each privilege display unit 25 functions so as to assign attribute information associated with a predetermined privilege to each pocket 16. A design having a correlation is used for each pocket 16 and each privilege display unit 25. In the example of FIG. 7, a circular arch portion is provided in each privilege display unit 25 so as to form part of the shape of each pocket 16. Further, in this example, for example, the hatched privilege display unit 25*a* is identical in position to the pocket 16*a*. That is, the hatched pocket 16*a* is associated with a privilege "×500" of the hatched privilege display unit 25*a*. Meanwhile, the pocket 16 adjacent to the right side of the hatched pocket 16*a* is associated with the privilege display unit 25*b* adjacent to the right side of the hatched privilege display unit 25*a*.

Figure 8:
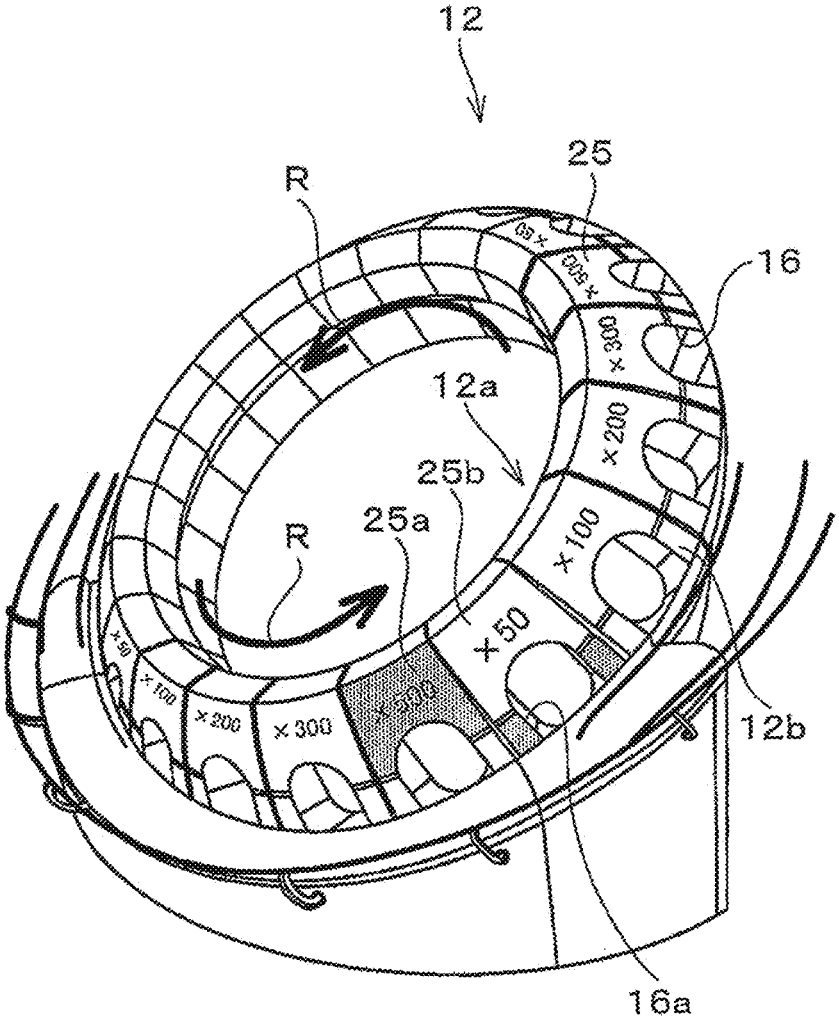
FIG. 8 is a diagram schematically illustrating a state after relative rotation has occurred between an award ring and a pocket ring.

In contrast, FIG. 8 is a diagram schematically illustrating a state after relative rotation has occurred between the award ring 12*a* and the pocket ring 12*b*. FIG. 8 illustrates an example in which relative rotation has occurred by one pocket (one unit) in a right rotation direction indicated by an arrow R. As illustrated in FIG. 8, with the relative rotation corresponding to one pocket between the award ring 12*a* and the pocket ring 12*b*, deviation corresponding to one pocket has occurred between the hatched pocket 16*a* and the hatched privilege display unit 25*a*. More specifically, the position of the hatched pocket 16*a* matches with the position of the privilege display unit 25*b* positioned at the position adjacent to the right side of the hatched privilege display unit 25*a* in FIG. 7. That is, the hatched pocket 16*a* is associated with a privilege "×50" of the privilege display unit 25*b* at the right side. As described above, with the relative rotation between the award ring 12*a* and the pocket ring 12*b*, a correspondence relation between each pocket 16 and each privilege display unit 25 is also deviated, and an attribute of each pocket 16 changes.

Figure 9:
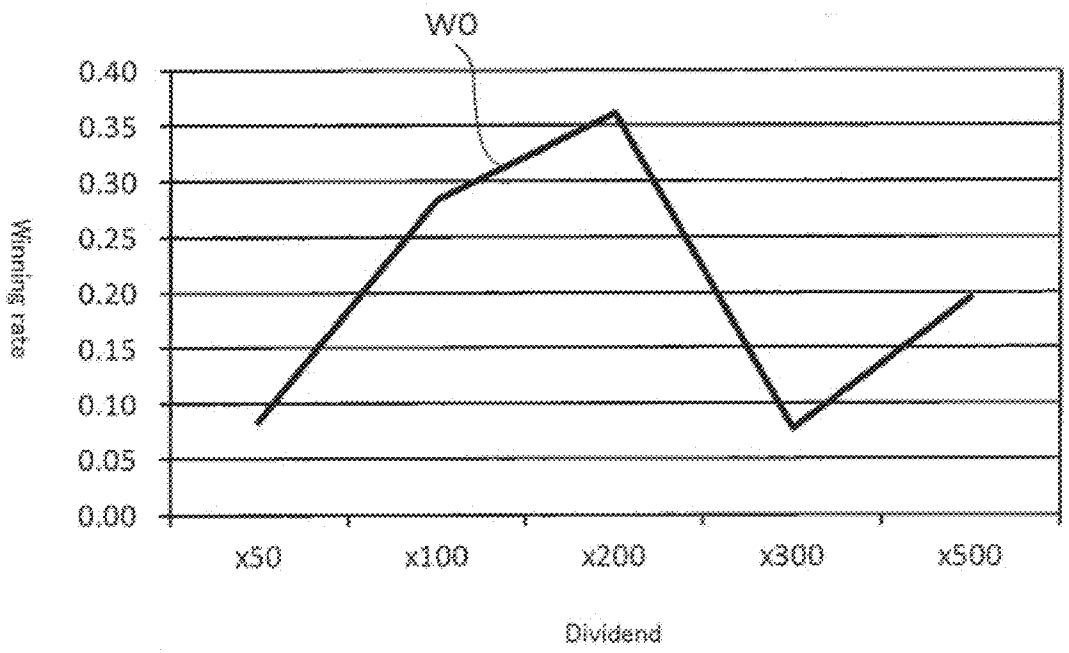
FIG. 9 is a diagram illustrating an example of a wining rate of each privilege.

FIG. 9 is a diagram illustrating an example of a wining rate of each privilege. FIG. 9 illustrates an example in which dividends such as "×50," "×100," "×200," "×300," and "×500 are associated with the privilege display units 25 in order as predetermined privileges. In FIG. 9, a horizontal axis denotes a dividend, and a vertical axis denotes a winning rate. The roulette ring 12 has the potential to have a variation, in a completed state, which occurs due to a component tolerance, an assembly error, and the like. In this case, there may be a difference between the pockets 16 when the ball enters the pockets 16. For this reason, winning rates of dividends, that is, probabilities that dividends will be assigned may vary. As an example, as indicated by a solid line W0 in FIG. 9, a variation in a winning rate may form a wave in which a winning rate goes down or up according to each dividend.

Figure 10:
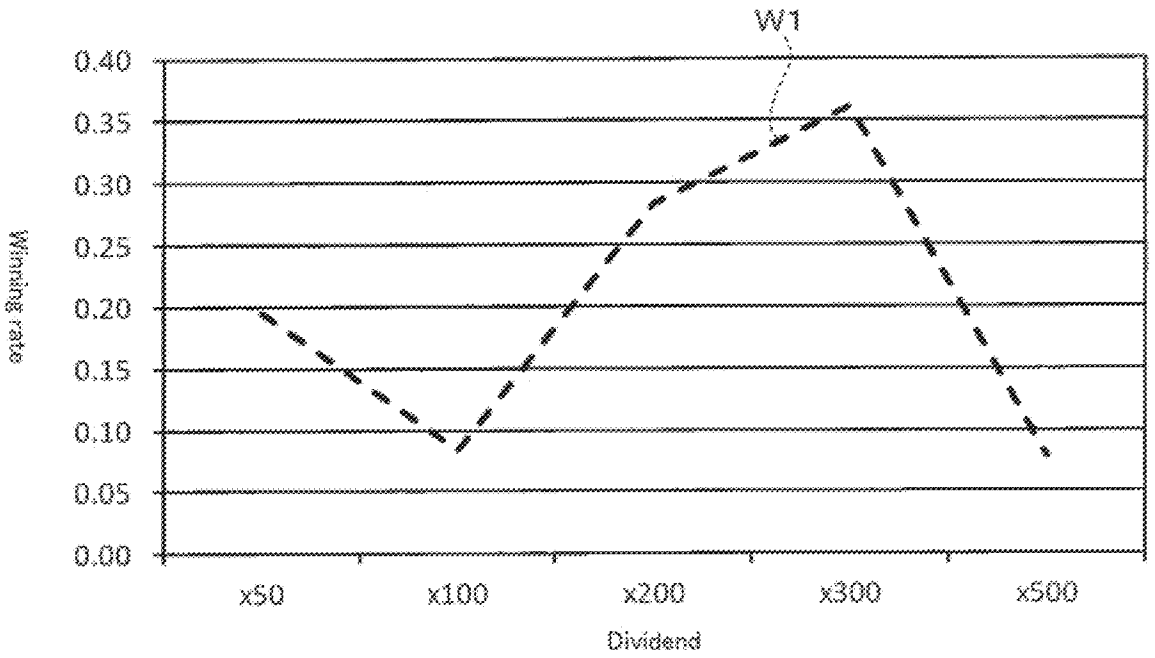
FIG. 10 is a diagram illustrating a winning rate of each privilege after relative rotation corresponding to one pocket has occurred between an award ring and a pocket ring.

FIG. 10 is a diagram illustrating a winning rate of each privilege after relative rotation corresponding to one pocket has occurred between the award ring 12*a* and the pocket ring 12*b*. In this case, a dividend associated with each pocket 16 is deviated by a degree corresponding to one pocket. For example, when the relative rotation occurs in the right direction, a correspondence relation between each pocket 16 and each privilege display unit 25 is deviated by a degree corresponding to one pocket 16 in the right direction. That is, in this case, after the relative rotation, for example, each privilege display unit 25 of the right side, which has been associated with each pocket 16 before the relative rotation is associated with each pocket 16. For this reason, as in an example indicated by a dotted line W1 in FIG. 10, a wave representing a variation in a winning rate of each dividend is deviated in a horizontal direction by a degree corresponding to one dividend in comparison to the example of FIG. 9. Specifically, a winning rate of a dividend "×50" of FIG. 9 is illustrated as a winning rate of a dividend "×100" in FIG. 10. Similarly, in FIG. 10, a winning rate of a dividend "×100" of FIG. 9 is illustrated as a winning rate of a dividend "×200," a winning rate of a dividend "×200" of FIG. 9 is illustrated as a winning rate of a dividend "×300," and a winning rate of a dividend "×300" of FIG. 9 is illustrated as a winning rate of a dividend "×500." Further, a winning rate of a dividend "×500" of FIG. 9 is illustrated as a winning rate of a dividend "×50" in FIG. 10.

Figure 11:
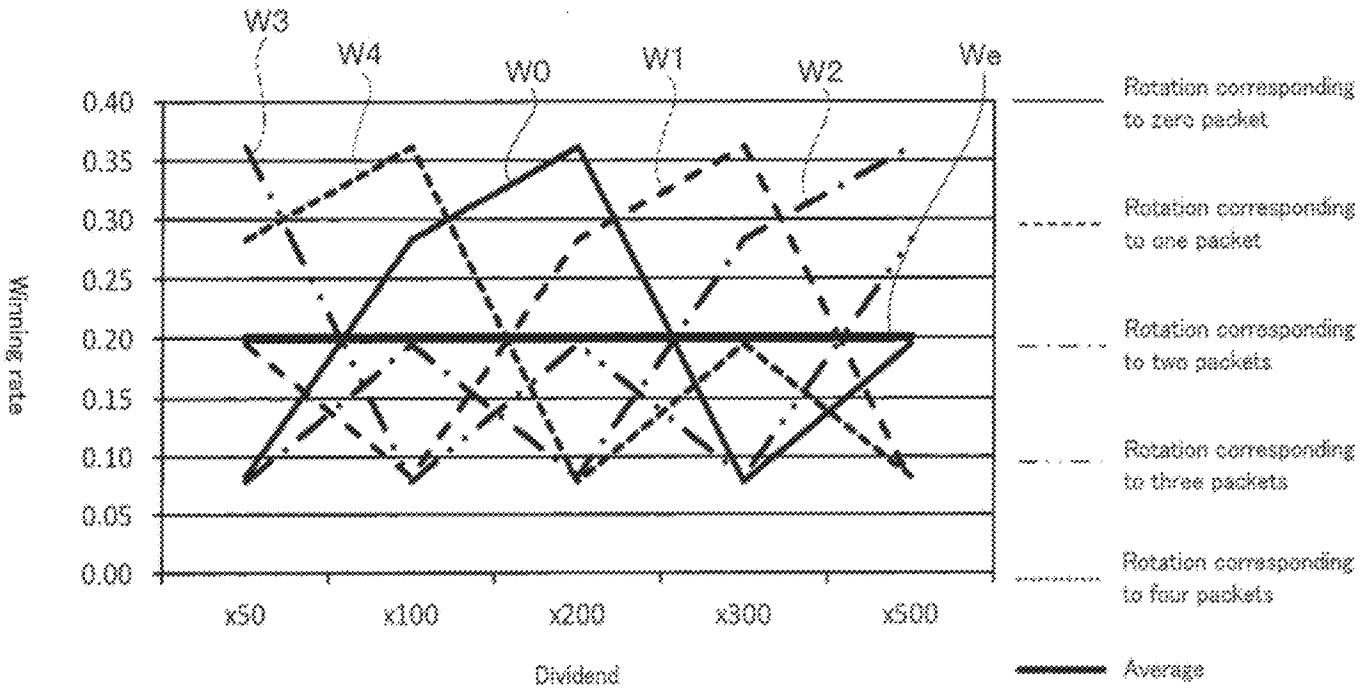
FIG. 11 is a diagram illustrating a change in a winning rate of each privilege with relative rotation between an award ring and a pocket ring.

FIG. 11 is a diagram illustrating a change in a winning rate of each privilege with the relative rotation between the award ring 12*a* and the pocket ring 12*b*. In FIG. 11, a solid line W0 represents a winning rate before relative rotation occurs, a dotted line W1 represents a winning rate when relative rotation corresponding to one packet has occurred, an alternate long and short dash line W2 represents a winning rate when relative rotation corresponding to two packets has occurred, an alternate long and two short dashes line W3 represents a winning rate when relative rotation corresponding to three packets has occurred, and a fine dotted line W4 represents a winning rate when relative rotation corresponding to four packets has occurred. As illustrated in FIG. 11, as relative rotation between the award ring 12*a* and the pocket ring 12*b* such as one pocket, two pockets, and so on occurs, a wave representing a variation in a winning rate is deviated in a horizontal direction by one dividend. Thus, when relative rotation corresponding to four pockets has occurred, an average winning rate is converged to a value of "0.2" as indicated by a bold line We. That is, when relative rotation corresponding to four pockets (a number which is one smaller than the number of the types of dividends) has occurred between the award ring 12*a* and the pocket ring 12*b* by unit by unit, a winning rate becomes uniform.

Figure 12:
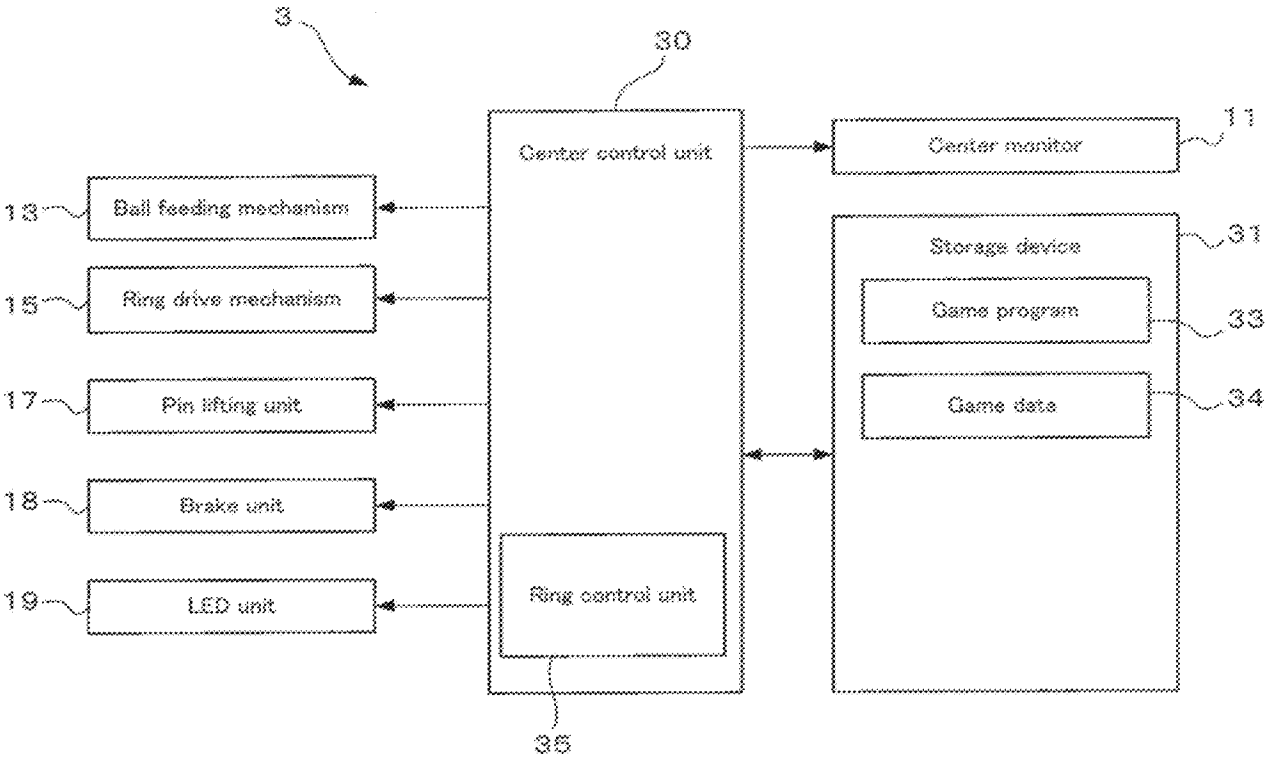
FIG. 12 is a functional block diagram illustrating a schematic configuration of a control system of a center unit.

Next, a configuration of a control system of the center unit 3 will be described with reference to FIG. 12. FIG. 12 is a functional block diagram illustrating a schematic configuration of a control system of the center unit 3. As illustrated in FIG. 12, a center control unit 30 is provided in the center unit 3. The center control unit 30 is configured as a computer unit that controls the center unit 3. Specifically, the center control unit 30 is configured as a computer unit that includes a microprocessor, a main storage device necessary for an operation thereof, and other peripheral devices.

The ball feeding mechanism 13, the ring drive mechanism 15, the pin lifting unit 17, the brake unit 18, the LED unit 19, and the center monitor 11 are connected to the center control unit 30. A storage device 31 is further connected to the center control unit 30. Examples of the storage device 31 include a storage medium that retains stored information after power is turned off such as a magnetic storage medium such as a hard disk drive (HDD), an optical storage medium such as a digital versatile disc read only memory (DVD-ROM), or a non-volatile semiconductor memory such as electrically erasable programmable read only memory (EEPROM).

The storage device 31 stores a game program 33 and a game data 34. The game program 33 refers to a program necessary for the center unit 3 to execute the roulette game. The game data 34 refers to a variety of data used when the game program 33 is executed. The game data 34 includes a variety of data such as background music (BGM) data for replaying various BGMs or sound effects in a roulette game, attribute management data for managing an attribute (that is, a correspondence relation between each pocket 16 and each privilege display unit 25) of each pocket 16, and winning rate management data for managing a winning rate. The game program 33 is appropriately read and executed by the center control unit 30. The game data 34 is appropriately read and referred to by the center control unit 30.

As the game program 33 is executed, a ring control unit 35 is provided in the center control unit 30. The ring control unit 35 executes a variety of processes necessary for the center unit 3 to provide a roulette game. For example, the ring control unit 35 executes a process for controlling the ball feeding mechanism 13, the ring drive mechanism 15, the pin lifting unit 17, the brake unit 18, the LED unit 19, and the center monitor 11.

Specifically, the ring control unit 35 controls an image to be displayed in the center monitor 11, a ball feeding time in the ball feeding mechanism 13, a rotation speed of the roulette ring 12 in the ring drive mechanism 15, and the like. Similarly, in the pin lifting unit 17, for example, a switching operation between the constraint state and the release state of the roulette ring 12 is controlled. More specifically, the ring control unit 35 controls an operation of the pin lifting unit 17 such that the pair of protruding portions 17*c* operate between the non-contact position and the separation position as an example. Further, in the brake unit 18, for example, an operation for stopping rotation of the roulette ring 12 is controlled. More specifically, the ring control unit 35 controls the brake unit 18 such that the pair of brake pads 18*p* operates between the stop position and the release position as an example. Further, in the LED unit 19, for example, an emission direction of the LED light 19*a* is controlled by the ring control unit 35. The ring control unit 35 is a logical device which is implemented by a combination of computer hardware and a computer program.

Figure 13:
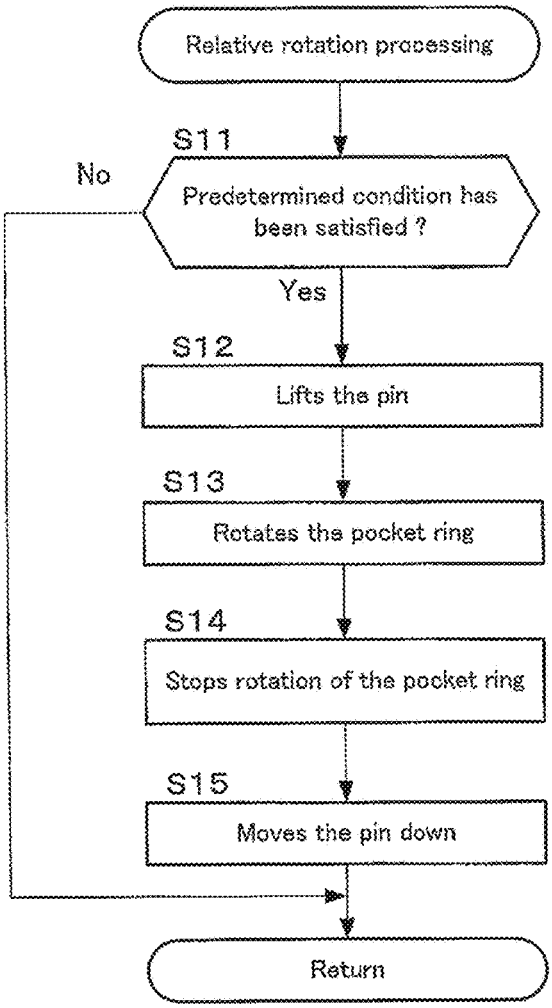
FIG. 13 is a diagram illustrating an example of a flowchart of a relative rotation processing routine.

Next, a relative rotation process executed by the center control unit 30 will be described. FIG. 13 is a diagram illustrating an example of a flowchart of a relative rotation processing routine executed by the center control unit 30. The center control unit 30 executes the routine of FIG. 13 through the ring control unit 35. The ring control unit 35 repetitively executes the routine of FIG. 13 at predetermined intervals. For example, as the predetermined interval, there is employed an interval such as each time when the lottery by the roulette ring 12 finishes. In addition, in addition to the routine of FIG. 13, for example, the center control unit 30 executes well-known various processes necessary for controlling operations of various mechanisms and units such as the ball feeding mechanism 13, the ring drive mechanism 15, the pin lifting unit 17, the brake unit 18, and the LED unit 19. Further, the center control unit 30 also executes well-known processes necessary for implementing a roulette game such as a process for providing a privilege (a privilege associated with the privilege display unit 25 corresponding to the pocket 16 which the ball B has entered) corresponding to a lottery result by the roulette ring 12. However, a detailed description thereof is omitted.

When the routine of FIG. 13 starts, in step S11, the ring control unit 35 first determines whether or not a predetermined condition has been satisfied. For example, a predetermined number of times counted based on previous relative rotation is employed as the predetermined condition. That is, in step S11, the ring control unit 35 determines whether or not the number of lottery times after the previous relative rotation has reached the predetermined number of times as an example. When the determination result is negative, that is, when it is determined that a lottery has not executed a predetermined number of times after the previous relative rotation, the ring control unit 35 skips subsequent processes and finishes the current routine. In contrast, when the determination result is positive, that is, when it is determined that a lottery has executed a predetermined number of times from the previous relative rotation, the ring control unit 35 proceeds to step S12.

In step S12, the ring control unit 35 lifts the pin 21*p* up through control of the pin lifting unit 17. Specifically, the pin lifting unit 17 is controlled in the following manner such that the pin 21*p* is lifted up. First, the ring control unit 35 acquires the position of the pin 21*p*. For example, the position is acquired using a simulation for displaying rotation and stop images of the roulette ring 12 on the center monitor 11. That is, as an example, the position of the pin 21*p* is acquired based on the simulation result of rotation and stop of the roulette ring 12. Next, the positions of the pair of protruding portions 17*c* and the constraining mechanism 21 are adjusted so that the pair of protruding portions 17*c* can engage with the engaging portion 21*a*. Then, in the state in which the pair of protruding portions 17*c* engages with the engaging portion 21*a*, the lifting portion 17*b* is lifted up until the pair of protruding portions 17*c* move to the separation position. As the pair of protruding portions 17*c* lift the engaging portion 21*a* up, the pin 21*p* is lifted up. In this way, the ring control unit 35 lifts the pin 21*p* up. In addition, the position of the pin 21*p* may be acquired based on a sensor, a camera, or the like.

Next, in step S13, the ring control unit 35 rotates the pocket ring 12*b* through control of the ring drive mechanism 15. As the pin 21*p* is lifted up in step S12, the roulette ring 12 is switched to the separation state (the release state). Thus, even though the pocket ring 12*b* rotates, the award ring 12*a* does not rotate. That is, relative rotation occurs between the pocket ring 12*b* and the award ring 12*a*.

Next, in step S14, the ring control unit 35 stops rotation of the pocket ring 12*b* at a predetermined position. For example, a position after rotation corresponding to one pocket is performed is employed as the predetermined position. That is, in this case, the ring control unit 35 stops the pocket ring 12*b* when the pocket ring 12*b* rotates by one pocket. For example, the predetermined position is acquired based on a simulation result of rotation and stop of the pocket ring 12*b*.

Next, in step S15, the ring control unit 35 moves the pin 21*p* down at a predetermined position. That is, as an example, the pin 21*p* is moved down so that the pin 21*p* can be inserted into the insertion portion corresponding to the adjacent pocket 16 which is distant by one pocket. When this process ends, the ring control unit 35 finishes the present routine. In this way, the roulette ring 12 is switched to the separation state (the release state) at intervals of a predetermined number of times, relative rotation occurs between the award ring 12*a* and the pocket ring 12*b*, and a winning rate of each privilege changes.

As described above, when a physical lottery mechanism is used, a lottery result may vary due to the component accuracy, the assembly accuracy, the installation accuracy, or the like. Meanwhile, fairness is required in a winning rate or the like based on a lottery result. That is, it is desirable that a winning rate of each privilege is flat.

As described above, according to this embodiment, the roulette ring 12 is configured so as to be able to divide into the award ring 12*a* and the pocket ring 12*b*. The pocket ring 12*b* is used for the lottery, and the award ring 12*a* is used to provide an attribute of the lottery result. Further, it is possible to cause relative rotation to occur between the pocket ring 12*b* and the award ring 12*a*. Thus, it is possible to change a correspondence relation between each pocket 16 and attribute information such as a privilege associated therewith. Thus, a variation in a wining rate occurring to a physical characteristic such as the component accuracy can be suppressed, and so a winning rate can become uniform.

Further, when electric power is supplied to a rotating object, various problems may occur. When electric power is supplied to a ring-shaped (a donut-shaped) rotating object, it is further difficult. For example, brush power supply may be used as a technique for supplying electric power to a ring-shaped rotating object. However, when brush power supply is used, there may be generated a problem that an electric wave is output and consumption of the brush is large.

According to this embodiment, an operation such as rotation of the roulette ring 12 or separation into the award ring 12*a* and the pocket ring 12*b* can be implemented by a mechanism (or a unit) different from the roulette ring 12. Further, a winning display is also implemented by the LED unit 19 by changing the emission direction of the LED light 19*a*. That is, it is unnecessary to supply electric power to the roulette ring 12. Thus, the winning rate can become uniform without supplying electric power to the ring-shaped roulette ring 12.

In the above embodiment, the center control unit 30 functions as the switching control device, the drive control device, and the rotation limiting control device by executing the routine of FIG. 13 through the ring control unit 35. Further, the center control unit 30 functions as the privilege providing device by executing a well-known process for providing a privilege corresponding to a lottery result by the roulette ring 12.

The present invention is not limited to the above embodiment and can be embodied by an appropriate embodiment. In the above embodiment, relative rotation occurs between the award ring 12*a* and the pocket ring 12*b* so that deviation corresponding to one pocket can be sequentially made. However, the relative rotation is not limited to this embodiment. For example, relative rotation may occur so that a correspondence relation between each pocket 16 and each privilege display unit 25 can be deviated according to a predetermined unit, for example, by two units. Or, relative rotation may occur so that a correspondence relation between each pocket 16 and each privilege display unit 25 can be randomly deviated.

In the above embodiment, a condition satisfied when the number of lottery times from previous relative rotation has reached a predetermined number of times is employed as a predetermined condition to incur relative rotation. However, the predetermined condition is not limited to this embodiment. For example, a condition satisfied when a winning rate of a predetermined threshold or more (or less) has occurred may be employed as the predetermined condition. In this case, the occurrence of a privilege of a notably high (or low) winning rate can be prevented. Further, for example, as the predetermined condition, there may be employed a game progress condition such as a case that specific development has occurred during a game. Further, a condition such as when a predetermined operation is executed by a player, an administrator, or the like may be employed as the predetermined condition.

In the above embodiment, attribute information related to a privilege or the like is employed as predetermined information. However, the predetermined information is not limited to this embodiment. For example, attribute information related to a penalty opposite to a privilege may be employed as the predetermined information. Or, information related to a random number may be employed as the predetermined information. In this case, for example, the roulette ring 12 may be used to acquire a random number. Thus, it is possible to implement a physical lottery mechanism which can suppress bias of an acquired random number. Thus, the use of the lottery ring is not limited to a game such as the roulette game. The lottery ring can be applied to various uses for executing a lottery using a physical lottery medium. According to the present invention, a relation between a lottery result and information associated with the result can be changed. Thus, bias of a lottery result to specific information can be suppressed. Thus, it is possible to suppress bias of a lottery result caused due to a component error or the like in various uses.

In the above embodiment, the first ring and the second ring are arranged so as to form a layer in the up-down direction. However, the layer formed by the first ring and the second ring is not limited to this embodiment. For example, the two rings may be arranged in the same plane so as to form a layer in a radius direction.

Further, the switching device and the limiting device may not be provided. In this case, for example, switching of the constraining device may be manually implemented by an administrator or the like. Thus, various embodiments may be employed as an embodiment of the constraining device as long as the lottery ring can be switched between the constraint state and the release state.

What is claimed is:

1. A lottery ring comprising:

a first ring and a second ring that have a ring shape and are arranged along a central axis so as to form a layer;

a switching device comprising a plurality of lifting units spaced radially from the central axis;

a constraining device corresponding to the plurality of lifting units and that operates between a constraint state for constraining the first ring and the second ring such that the first ring and the second ring integrally rotate and a release state for releasing the constraint state such that the first ring and the second ring relatively rotate, information providing units that are arranged along the rotation direction and associated respectively with predetermined information is provided at the second ring;

a rotary drive device that rotationally drives at least one of the first ring and the second ring;

a drive control device that controls the rotary drive device such that at least one of the first ring and the second ring rotates in the release state;

a rotation limiting device that operates between a limiting state for limiting rotation of either of the first ring and the second ring and a permission state for permitting rotation;

a switching control device including a processor to communicate with and activate the plurality of lifting units; and wherein the drive control device controls the rotary drive device such that one of the first ring and the second ring whose rotation is not limited by the limiting device rotates in the release state.

2. The lottery ring according to claim 1, wherein the first ring and the second ring are arranged in an up-down direction so as to form upper and lower layers as the layer.

3. The lottery ring according to claim 2, wherein the first ring is arranged under the second ring so as to form the lower layer of the upper and lower layers.

4. A game machine, comprising:

the lottery ring unit according to claim 1; and the switching control device that controls the switching device such that the state of the constraining device is switched from the constraint state to the release state when a predetermined condition is satisfied.

5. The game machine according to claim 4, further comprising:

a rotation limiting control device that controls the rotation limiting device such that a state of the rotation limiting device is switched to the permission state in the constraint state and is switched to the limiting state in the release state.

6. The game machine according to claim 4, wherein attribute information related to a predetermined privilege is used as the predetermined information.

7. The game machine according to claim 4, wherein the number of lottery times using the lottery ring unit is used as the predetermined condition, and the predetermined condition is satisfied when the number of lottery times has reached a predetermined number of times.

8. The game machine according to claim 4, wherein the drive control device controls the rotary drive device such that a correspondence relation between an accommodating unit and the information providing unit is deviated in the rotation direction by a degree corresponding to one accommodating unit.

9. A control method of controlling a computer which is incorporated in a game machine including the lottery ring unit according to claim 1, wherein the control method of controlling the computer comprises the steps:

a step that controls the rotation limiting device to operate between the limiting state and the permission state for either of the first ring and the second ring;

a switching control step that controls the switching device such that the state of the constraining device is switched from the constraint state to the release state when a predetermined condition is satisfied; and a drive control step that controls the rotary drive device such that at least one of the first ring and the second ring whose rotation is not limited by the limiting device rotates in the release state.

10. A computer program for a game machine being configured to make a computer incorporated into a game machine including the lottery ring unit according to claim 1 serve as:

a rotation limiting device that controls the rotation limiting device to operate between the limiting state and the permission state for either of the first ring and the second ring;

a switching control device that controls the switching device such that the state of the constraining device is switched from the constraint state to the release state when a predetermined condition is satisfied; and a drive control device that controls the rotary drive device such that at least one of the first ring and the second ring whose rotation is not limited by the limiting device rotates in the release state.

* * * * *